US009330866B2

(12) United States Patent
Gerving et al.

(10) Patent No.: US 9,330,866 B2
(45) Date of Patent: May 3, 2016

(54) ELECTRICAL SWITCHING DEVICE

(71) Applicant: Eaton Electrical IP GmbH & Co. KG, Schoenefeld (DE)

(72) Inventors: Karsten Gerving, Bonn (DE); Volker Lang, Bonn (DE); Johannes Meissner, Bonn (DE); Ralf Thar, St. Augustin (DE)

(73) Assignee: EATON ELECTRICAL IP GMBH & CO. KG, Schoenefeld (DE)

( * ) Notice: Subject to any disclaimer, the term of this patent is extended or adjusted under 35 U.S.C. 154(b) by 10 days.

(21) Appl. No.: 14/135,616

(22) Filed: Dec. 20, 2013

(65) Prior Publication Data

US 2014/0175062 A1 Jun. 26, 2014

(30) Foreign Application Priority Data

Dec. 20, 2012 (DE) ..... 10 2012 112 779

(51) Int. Cl.
*H01H 33/53* (2006.01)
*H01H 9/34* (2006.01)
*H01H 50/54* (2006.01)

(52) U.S. Cl.
CPC ..... *H01H 33/53* (2013.01); *H01H 9/342* (2013.01); *H01H 50/546* (2013.01)

(58) Field of Classification Search
CPC ..... H01H 9/30; H01H 9/34; H01H 9/342; H01H 9/36; H01H 9/443; H01H 33/182
USPC ..... 218/157, 155; 200/306; 335/201, 202
See application file for complete search history.

(56) References Cited

U.S. PATENT DOCUMENTS

| | | | | |
|---|---|---|---|---|
| 4,684,772 | A | 8/1987 | Lehman | |
| 5,811,749 | A * | 9/1998 | Bausch et al. | 218/157 |
| 6,198,063 | B1 * | 3/2001 | Kramer | 218/157 |
| 6,388,867 | B1 | 5/2002 | Rakus et al. | |
| 6,512,192 | B1 * | 1/2003 | Yee et al. | 218/157 |
| 7,034,241 | B2 * | 4/2006 | Fleege et al. | 218/157 |
| 7,679,477 | B2 * | 3/2010 | Portier | 335/132 |
| 2008/0174391 | A1 * | 7/2008 | Bolz | H01H 50/443 335/202 |
| 2010/0243610 | A1 * | 9/2010 | Scola et al. | 218/4 |
| 2012/0139672 | A1 * | 6/2012 | Takaya | H01H 9/043 335/185 |
| 2012/0168405 | A1 * | 7/2012 | Rival et al. | 218/47 |

FOREIGN PATENT DOCUMENTS

| | | | |
|---|---|---|---|
| DE | 8531352 | U1 | 1/1986 |
| DE | 19828417 | A1 | 7/1999 |
| EP | 0505794 | A1 | 9/1992 |
| FR | 931585 | A | 2/1948 |
| FR | 2511188 | A1 | 2/1983 |
| JP | 03102731 | A | 4/1991 |

* cited by examiner

*Primary Examiner* — Renee S Luebke
*Assistant Examiner* — William Bolton
(74) *Attorney, Agent, or Firm* — Leydig, Voit & Mayer, Ltd.

(57) ABSTRACT

Electrical switching device having a housing, at least two switching chambers within the housing with contacts to interrupt at least one current path, an arc extinguishing device for each switching chamber, and at least one guide channel within the housing, which directs the arc gas exiting the arc extinguishing device towards at least one of the exhaust openings to allow the arc gases to exit the housing, whereby each switching chamber has a guide channel, and whereby the guide channels of the different switching chambers are separated from each other.

9 Claims, 6 Drawing Sheets

ELECTRICAL SWITCHING DEVICE

CROSS-REFERENCE TO RELATED APPLICATIONS

Priority is claimed to German Patent Application No. DE 10 2012 112 779.4, filed on Dec. 20, 2012, the entire disclosure of which is hereby incorporated by reference herein.

FIELD

The invention concerns an electrical switching device, for instance a contactor which includes a housing and at least two switching chambers within the housing with contacts for interrupting at least one current path. Each switching chamber is provided with an arc extinguishing device for extinguishing the arcs which can form when the contacts are opened. Additionally, there is at least one guide channel provided within the housing which can divert the arc gases which come out of the arc extinguishing devices in the direction of at least one exhaust opening and out of the housing.

BACKGROUND

A switching device of this kind is presented for example in U.S. Pat. No. 6,388,867 B1. A circuit breaker is presented there, which has a hood arrangement to guide the arc gases out of the housing. An arc which forms between the contacts of a contact pair of the circuit breaker is extinguished within the housing of the circuit breaker. For the duration of the arc, gases are released at high pressure and high ionization level; and these gases exit the housing through openings in an upper wall of the housing. The openings of several switching chambers of different current paths are arranged side by side. The openings are covered by a hood, which forms a channel for two exhaust openings facing away from each other. Hereby, all openings lead into the channel which goes through the hood. Thus, the highly ionised arc gases are led out or blown out of the housing from two sides.

Switching devices can generate a large quantity of arc gases when interrupting high currents and voltages. Arc gases are usually exhausted through the upper or rear side of the switching device. Electrical switching devices typically include many current paths (poles), and therefore, particularly in case of short circuits, flash-overs can occur during the blowing out of arc gases in the proximity of a terminal contact of a current path. In the switching device in accordance with U.S. Pat. No. 6,388,867 B1, flash-overs are prevented by exhausting the arc gases at the sides of the housing which are arranged as far away as possible from the terminal contacts.

In principle, switching devices are required in case of a short circuit to remain intact and flash-overs between different current paths (poles) should be avoided. The measures implemented for preventing the destruction of the housing of the switching device are: selection of suitable materials for the switching chambers and their wall thicknesses as well as the selection of the appropriate pressure release openings or exhaust openings which, particularly in the case of short circuits, blow out arc gases that form explosively. Short circuit currents that occur in direct current applications are difficult to control due to the fact that in this case there is no natural zero passage which would quickly interrupt the arc and therefore cause a permanent interruption of the circuit. Very compact switching devices exist, and these have short paths, which can easily be bridged over electrically by highly ionized arc gases and can consequently lead to flash-overs. Therefore, in very compact switching devices, flash-overs can occur between different contact pairs if highly ionized arc gases exit out of the housing and thereby bridge over several different switching chambers as in the case of a short circuit.

SUMMARY

In an embodiment, the present invention provides an electrical switching device. The electrical switching device includes: a housing; at least two switching chambers within the housing, including contacts configured to interrupt at least one current path; an arc extinguishing device for each switching chamber; and a respective guide channel within the housing for each switching chamber, the respective guide channel being configured to redirect the escaping arc gases towards at least one exhaust opening to allow the arc gases to exit from the housing. The respective guide channels of the switching chambers are separated from each other.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
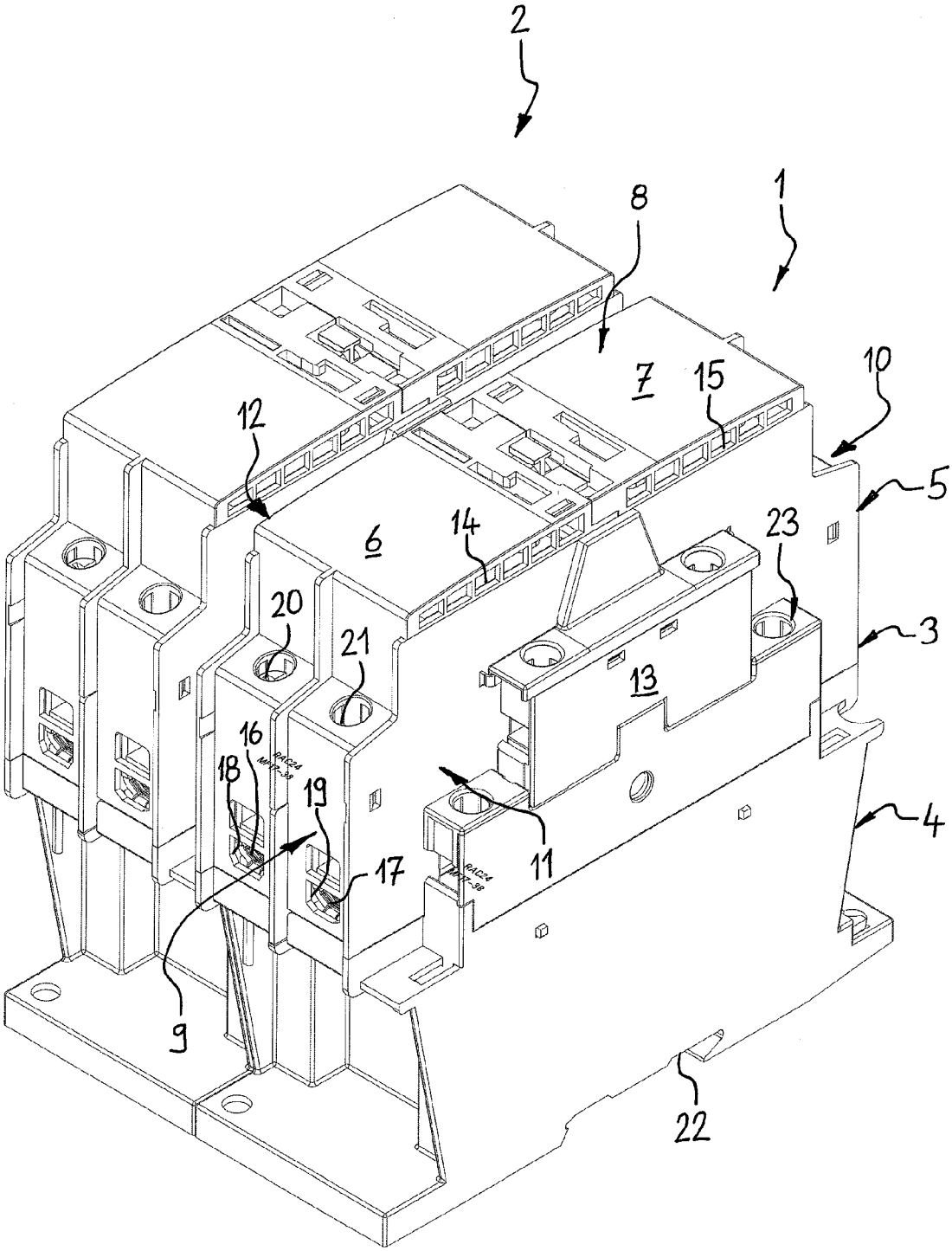
FIG. 1 perspective view of two electrical switching devices.

An aspect of the invention provides an electrical switching device which includes a housing, at least two switching chambers within the housing with contacts for interrupting at least one current path, an arc extinguishing device for each switching chamber as well as at least one guide channel within the housing which can divert the arc gases released by the arc extinguishing device in the direction of at least one exhaust opening to release the arc gases out of the housing. There is one guide channel assigned to each switching chamber, whereby the guide channels of the various switching chambers are separated from each other.

Each switching chamber is thus fitted with one guide channel for guiding arc gases to an exhaust opening, whereby the guide channels of different switching chambers are separated from each other. The arc gases of different switching chambers are not mixed immediately on exiting the arc extinguishing device, but are first guided separate of each other to the exhaust openings within the housing. Thus the distance between the different switching chambers is increased, which would need to be bridged over for a flash-over to occur between the switching chambers. The probability of a flash-over is thus reduced. There is a further positive effect that the arc gases are cooled and deionized further as they flow through the guide channels before the arc gases of two switching chambers come in contact with each other, further reducing the probability of a flash-over.

It can be provided for that the guide channels divert arc gases of all switching chambers to the exhaust openings on the same side of the housing. Generally the switching device has front sides, where connection contacts for the current paths (poles) of the switching devices are provided. Two front sides facing away from each other are connected, as a rule, at right angles to these side walls. Hereby, the exhaust openings are preferably in the side walls, preferably in one of the side walls, so as to avoid the arc gases being blown out in the region of the connection contacts.

Auxiliary switches are provided on the top side of the housing which is, as a rule, perpendicular to the front sides and perpendicular to the side walls, so that arc gases should not be blown out likewise on this side of the switching device.

The guide channels can be arranged in such a way that the arc gases of at least two switching chambers of different current paths are diverted to exhaust openings on opposite sides of the housing.

In a first preferred embodiment, the switching device has several current paths, each with double interrupting switches, whereby the arc gases of two current paths arranged next to each other are exhausted on different sides of the housing. Alternatively, the arc gases of both contact pairs of a double interrupting switch of a current path are exhausted on different sides of the housing, whereby the exhaust openings of several switching paths are arranged alternatingly on different sides of the housing.

Every guide channel can be divided into sub-channels running preferably in parallel. This results in guiding the arc gases regulated in channels. Further, the ribbed structure resulting from the arrangement of several sub-channels leads to an additional stiffening of the guiding channel. This is particularly of advantage if the guide channels are integrated in a side wall of the housing. The stability of the housing is thus improved.

To create guide paths as long as possible within the housing, the guide channels are arranged in such a manner that the arc gases are deflected by 90 degrees. Consequently the arc gases, which as a rule are exhausted out of the arc extinguishing device vertical to a side wall of the housing, are now diverted in a direction parallel to the side wall of the housing. Thus, the guide channels can be integrated in the appropriate side wall.

FIG. 1 shows two switching devices arranged next to each other in the form of two contactors 1, 2, whereby contactor 1, which is shown in the front in FIG. 1 is representative for both contactors 1, 2 and will be described in the following. The contactor 1 includes a housing 3 which has a lower case assembly 4 and an upper case assembly 5. The upper case assembly 5 is closed by a cover with a first cover half 6 and a second cover half 7.

The two cover halves 6, 7 make up the top side 8 of the housing 3, which is facing away from the lower case assembly 4. The cover halves 6, 7 make up front sides 9, 10 on the front side of the narrow surfaces which face away from each other, whereby, as in the case of contactors 1, 2 which are placed next to each other as shown in FIG. 1, the front sides 9, 10 of the contactors 1, 2 which are placed next to each other, are arranged in pairs on the same side.

The upper case assembly 5 forms two side walls 11, 12 of the housing 3, whereby two side walls 11, 12 of two contactors 1, 2 placed next to each other, are arranged opposite to each other. The upper case assembly 5 forms a step 23 on one of the sidewalls 11, on which a connection module 13 is provided. Near the contactors 1, 2, which are placed next to each other, there is the connection module 13 of one of the two contactors 1, 2, which is arranged between the side walls 11, 12 of the two contactors 1, 2. The side walls 11, 12 of the two contactors 1, 2 are thus always arranged at a distance from each other.

In one of the side walls 11 of the two side walls 11, 12, the first cover half 6 as well as the second cover half 7 have exhaust openings 14, 15, which are meant for exhausting the arc gases from the housing 3 into the exterior.

The contactor 1 is a double pole contactor 1 with two current paths running parallel to each other, whereby contact openings 18, 19 are provided in one front side 9 of the two front sides 9, 10, which are accessible through terminal contacts 16, 17 located inside the housing 3. The terminal contacts 16, 17 are each terminal contacts of one current path which runs parallel to the side walls 11, 12 through the housing 3. On the front side, not shown here, which is facing away from the front side 9, there are identically formed connection openings with the terminal contacts located in them. The terminal contacts 16, 17 are shaped as clamps which can be accessed and operated with a screw driver through the screw openings 20, 21 in the cover halves 6, 7, to connect the terminal contacts 16, 17 to current conducting elements. In principle though, other electrical switching devices with more than two poles can also be provided.

The current paths are arranged in the upper case assembly 5, whereby each current path includes a switch with contact pairs which can electrically interrupt the current path. Hereby, arcs can form between the contacts of a contact pair, which can be led out of the housing 3 through the exhaust openings 14, 15. Each contact pair has a switching chamber with an arc extinguishing device, as explained in greater detail below. The switches can be operated by a magnetic drive, which is located in the lower case assembly 4.

Furthermore, the lower case assembly has an attachment recess 22 which is used to attach the contactor 1 to a mounting rail.

Figure 2:
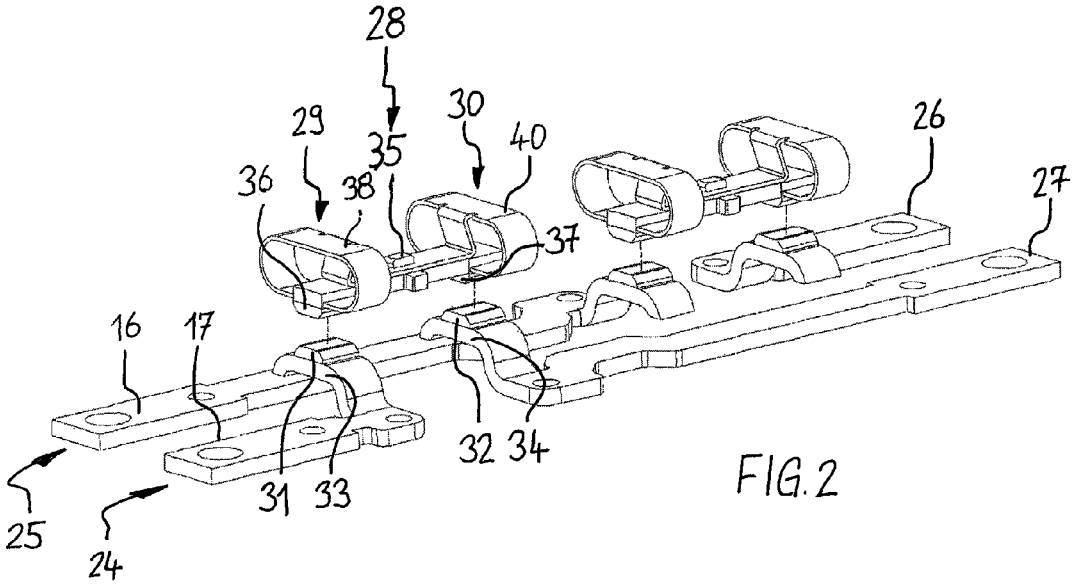
FIG. 2 two current paths of the switching device in accordance with FIG. 1.

FIG. 2 shows the first current path 24 and the second current path 25, which are arranged in the housing in accordance with FIG. 1. The current paths 24, 25 each have a first terminal contact 16, 17 and then run to a second terminal contact 26, 27. The current paths 24, 25 can be connected to a current circuit, preferably a direct current circuit, through the terminal contacts 16, 17, 26, 27. In the following, current path 24 will be described representative for both current paths 24, 25.

A switch 28 is provided between the two terminal contacts 17, 27 of the first current path 24. This includes a first contact pair 29 and a second contact pair 30. The first terminal contact 17 leads to the first contact pair 29. The second terminal contact 27 leads to the second contact pair 30. Both contact pairs 29, 30 are in the housing of the contactor in separate switching chambers which are insulated from each other.

The first terminal contact 17 is electrically connected to a contact support in the form of a stationary fixed contact support 33, on which a first contact 31 of the contact pair 29 is arranged. A second contact 36 of the first contact pair 29 is arranged movable with respect to contact 31. The second contact 36 is vertically adjustable in the alignment shown in FIG. 2. The second contact 36 is provided on an electrically conducting contact support in the form of a bridge contact element 35, which is adjustable with a switching bridge not shown here. In a switched-on state, the first contact 31 and the second contact 36 are in kept contact with each other. In a switched-off state in accordance with FIG. 2, the first contact 31 and the second contact 36 are kept out of contact of each other.

The second terminal contact 27 is connected to a contact support in the form of another stationary fixed contact support 34. Another first contact 32 of the second contact pair 30 is arranged on the other fixed contact support 34. In addition to this, another second contact 37 is kept movable, which is also arranged on the bridging contact element 35 and can be shifted in-contact or out-of-contact with the first contact 32 of the second contact pair 30. Thus, both contacts are simultaneously opened or closed by adjusting the bridging contact element 35.

When shifting the bridging contact element 35 into an open position, arcs can form between the contacts 31, 32, 36, 37 of the contact pairs 29, 30; and these arcs must be extinguished. For this, an extinguishing device is provided on the side facing away from the second contact 36, 37 of the first contacts 31, 32, whereby the arcs are diverted into the extinguishing devices over a guide rail arrangement, to be explained in detail below, for each contact pair 29, 30.

Figure 3:
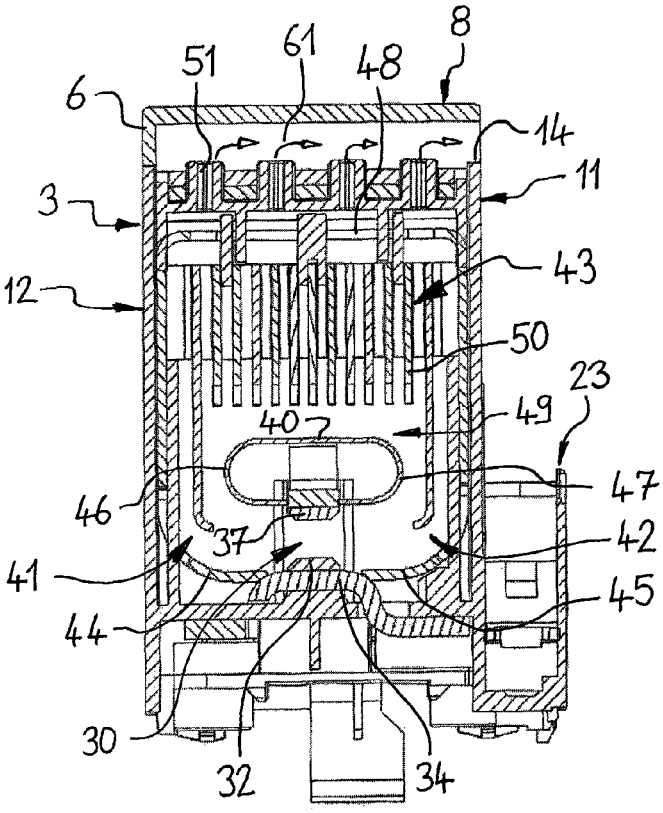
FIG. 3 cross section view of a switching chamber of one of the switching devices in accordance with FIG. 1.

FIG. 3 shows a cross section view of the housing in accordance with FIG. 1 through a switching chamber in which the second contact pair 30 is arranged in accordance with FIG. 2. The figure shows that a first guide rail arrangement 41 and a second guide rail arrangement 42 is provided for guiding an arc that forms between the first contact 32 and the second contact 37. The first guide rail arrangement 41 is meant for guiding an arc with a first direction of current into an arc extinguishing device 43, which is located on the side facing away from the first contact 32 of the second contact 37 within the switching chamber 49. The second guide rail arrangement 42 is meant for guiding an arc with a second direction of current into the same arc extinguishing device 43.

The first guide rail arrangement 41 is represented by a first guide rail 44 and a second guide rail 46. The second guide rail arrangement 42 is similar to the first guide rail arrangement 41; and it comprises a first guide rail 45 and a second guide rail 47. The two first guide rails 44, 45 run in opposite directions from the first contact 32 and lead to the arc extinguishing device 43, which is located between the first guide rails. The two first guide rails 44, 45 are connected to each other by a connecting bracket 48, at their terminations facing away from the first contact 32. Thus, the two first guide rails 44, 45 form a closed ring or a closed loop that surrounds the second contact pair 30. The second guide rails 46, 47 run in opposite directions from the second contact 37 and are connected to each other on the side facing away from the first contact 32 of the second contact 37 while forming a closed guide rail ring 40.

In principle, the first guide rails 44, 45 and the second guide rails 46, 47 must not make up a loop with one another or be connected to each other. Other designs for guide rails 44, 45, 46, 47 are also conceivable.

The first guide rail 44 of the first guide rail arrangement 41 runs, as seen in FIG. 3, initially to the left and is subsequently diverted 90 degrees upwards, whereby the distance between the first guide rail 44 and the second guide rail 46 increases gradually. The arc therefore is therefore formed between these two guide rails 44, 46 and is driven from the second contact pair 30, for a first direction of current, towards the left and then upwards. Subsequently, the arc will run along the rear side of the bridging contact element 35 on the side facing away from the first contact 32, whereby the arc is successively driven into the slits between the individual extinguishing plates 50 of the arc extinguishing device 43. On an upper side of the arc extinguishing device 43 there are exhaust openings 51 for the purpose of blowing out arc gases released by the arcs from the switching chamber 49 and the arc extinguishing device 43. The second guide rail arrangement 42 is built as a mirror image of the first guide rail arrangement 41.

In the extinguishing device made up as a Deion-extinguishing chamber, the arc loses so much energy due to forming several partial arcs between the extinguishing plates 50 and due to the cooling effect that the driving voltage is reached quickly, and the arc is extinguished. In the case of a high-energy arc, e.g. in a strong inductive circuit, the arc may lose only part of its energy after running into the arc extinguishing device 43, and the individual partial arcs between the extinguishing plates 50 run through the arc extinguishing device in its full width under the effect of a permanent-magnetic blow-out field. The arc can then run back in the direction of the second contact pair 30. After "passing" the second contact pair 30, the arc can then run again along the guide rail arrangement in the direction of the arc extinguishing device 43. In case of sufficient residual energy, several running cycles can occur until the arc finally loses so much energy that it extinguishes. The arc voltage drops after going through the arc extinguishing device 43 and subsequently going through the second contact pair 30, however this short-term drop of voltage does not have a strong influence on the continuous and fast forward movement of the arc. When the arc enters the extinguishing device 43 repeatedly, the arc voltage increases again, so that the arc is finally extinguished completely.

FIG. 3 shows outlets 51 included in the embodiment, which lead from the arc extinguishing device 43 to a guide channel 61, which is formed in the first half of the cover 6 from the upper case assembly 5 and has an exhaust opening 14 arranged at the first lateral side 11 of the housing 3. According to the orientation of the device as shown in FIG. 3, the arc gases are released from outlets 51 facing vertically upwards and diverted by 90 degrees into a horizontal exhaust direction and travelling to the right, as indicated by the arrows.

The closed embodiment of the guide rails 44, 45, 46, 47 in the form of loops has the additional advantage that the switching chamber 49 is separated and stabilized in the upwards, downwards direction and on both sides through rails 44, 45, 46, 47 in the plane presented in FIG. 3.

Figure 4:
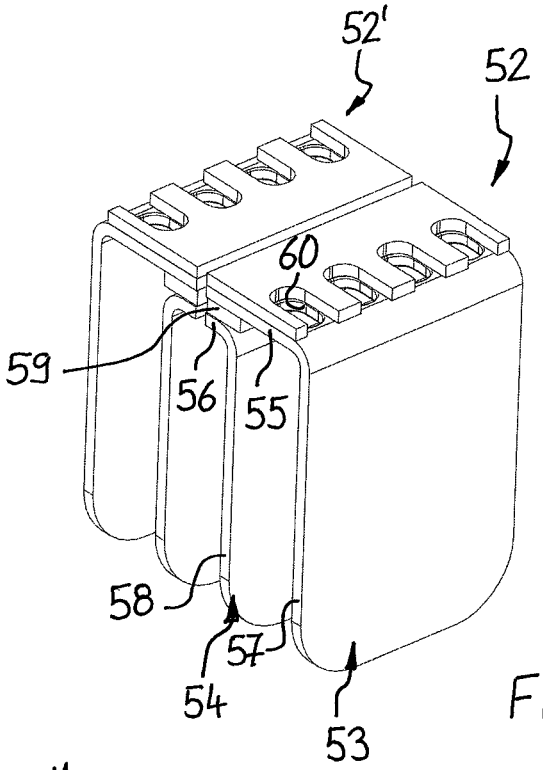
FIG. 4 an arc driver arrangement of a switching device in accordance with FIG. 1.

In order to move arcs that form between the contacts of the contact pairs in the direction for the arc extinguishing device, each contact pair has an arc driver arrangement 52 in accordance with FIG. 4. There are two arc driver arrangements 52, 52' arranged next to each other, which are designed as mirror images of each other and are both used for one switch. One of the two arc driver arrangements 52 is explained as an example below. This includes an outer pole element 53 and an inner pole element 54. Each of the two pole elements 53, 54 have parallel running base bridges 55, 56, and a pole plate 57, 58 extends from each of these base bridges at a right angle. The two pole plates 57, 58 of the two pole elements 53, 54 are also arranged parallel to each other. The inner pole element 54 is designed smaller than the outer pole element 53 so that the inner pole element 54 can be arranged within the outer pole element 53. A permanent magnet 59 is arranged between the two base bridges 55, 56, which are arranged with a distance between them. Thus, a magnetic field is formed between the two pole plates 57, 58 with nearly parallel magnetic field lines. The contacts of a contact pair are arranged between the two pole plates 57, 58.

The base bridges 55, 56 have a variety of openings 60, for letting the arc gases formed in the respective switching chamber exit through the outlet openings in accordance with FIG. 3.

Figure 5:
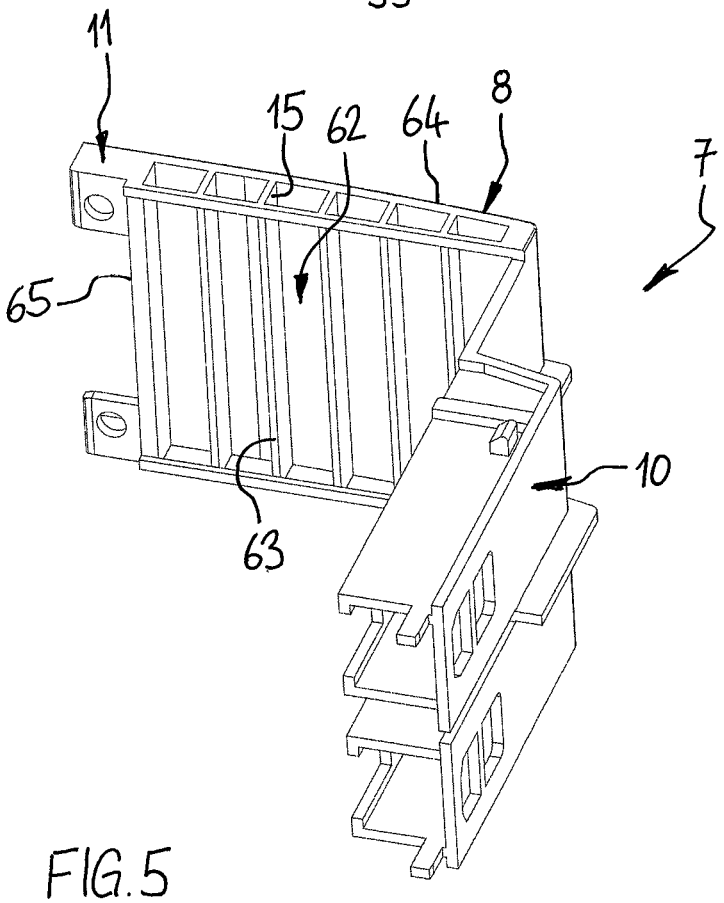
FIG. 5 half of a cover of a switching device in accordance with FIG. 1.

FIG. 5 shows the second half of the cover 7 of contactor 1 in accordance with FIG. 1. The second half of cover 7 has a housing wall 64 at the upper side 8; and guide channels are formed by a multitude of parallel running partial channels 62 in this housing wall. The partial channels 62 are formed by ribs 63 going inward to the inside of the housing. The partial channels 62 each lead to an outlet opening 15 on the first long side 11. The partial channels 62 are open inward to the inside of the housing and point to the base bridges of the respective arc driver arrangement and are covered by the arc driver arrangements towards the inside so that at least nearly closed partial channels 62 are formed. Several partial channels 62 can each form a guide channel for the arc gases of a switching chamber. In the arc driver arrangements the openings align with one or several of the partial channels 62. The partial channels 62 run parallel to a joint edge 65 of the second half of the cover 7, and the first half of the cover abuts to this edge in accordance with FIG. 1. The two halves of the cover both have an identical structure with respect to the partial channels 62 to ensure that the partial channels 62 of the second half of the cover are separated from the partial channels of the first half of the cover 6. Furthermore, the individual partial channels 62 of a cover half form a guide channel separately or together, whereby each guide channel is separated from the other guide channels by the ribs 63 so that the arc gases coming from different contact pairs are not mixed within housing 3.

Figure 6:
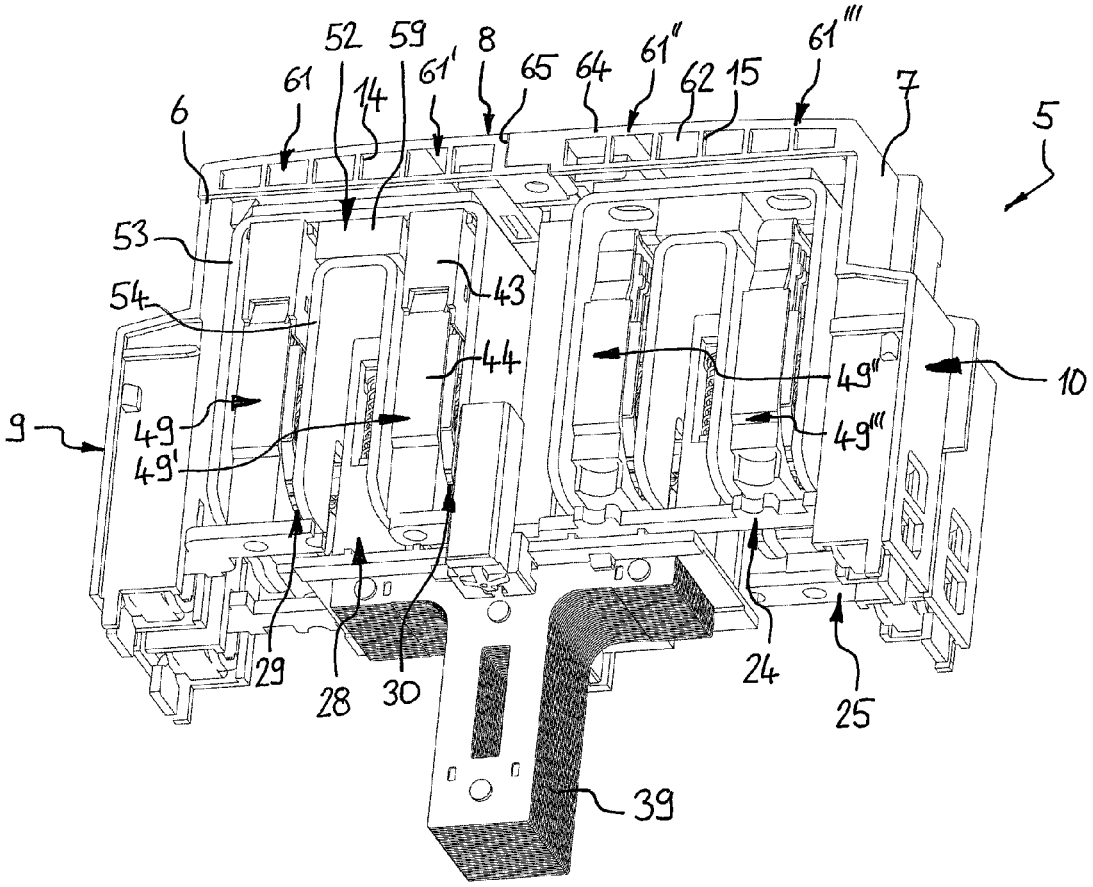
FIG. 6 the cover of a switching device in accordance with FIG. 1 with switching chambers.

FIG. 6 shows a section of the upper case assembly 5 with the first cover half 6 and the second cover half 7. Current paths 24, 25 are located in the above covers halves with their switches 28 and the contact pairs 29, 30. The guide rail arrangements, in particular the first guide rail 44, are shown in the figure along with the arc extinguishing device 43. The arc driver arrangement 52 has a similar structure as shown in FIG. 4, whereby the two separate arc driver arrangements 52 shown in FIG. 4 are designed as single pieces in FIG. 6 so that in contrast to FIG. 4, there are no two adjacently arranged L-shaped pole elements, but rather a U-shaped inner pole element 54 and a U-shaped outer pole element 53. Otherwise, the arc driver arrangements 52 are formed corresponding the respective arrangements shown in FIG. 4.

FIG. 6 shows a switching bridge 39, which is located within the lower case assembly in accordance with FIG. 1 and can be moved there by a magnetic drive. On the switching bridge 39, you will find the bridge circuits 35 of both current paths 24, 25, so that all contact pairs 29, 30 of all switches 28 within the housing 3 open or close at the same time.

The figure shows that the openings 60 of the arc driver arrangements 52 discharge into the partial channels 62 of the housing halves 6, 7 so that arc gases from the switching chambers 49 within the housing wall 64 of the respective cover half 6, 7 are directed and guided towards the outlet openings 14, 15. The arc gases are therefore blown out exclusively on the longitudinal side shown from the front in FIG. 6, and not on the second longitudinal side facing away from this longitudinal side. The partial channels 62 are separated from each other, by the ribs 63 shown in FIG. 5, whereby several partial channels arranged next to each other form a guide channel.

Figure 7:
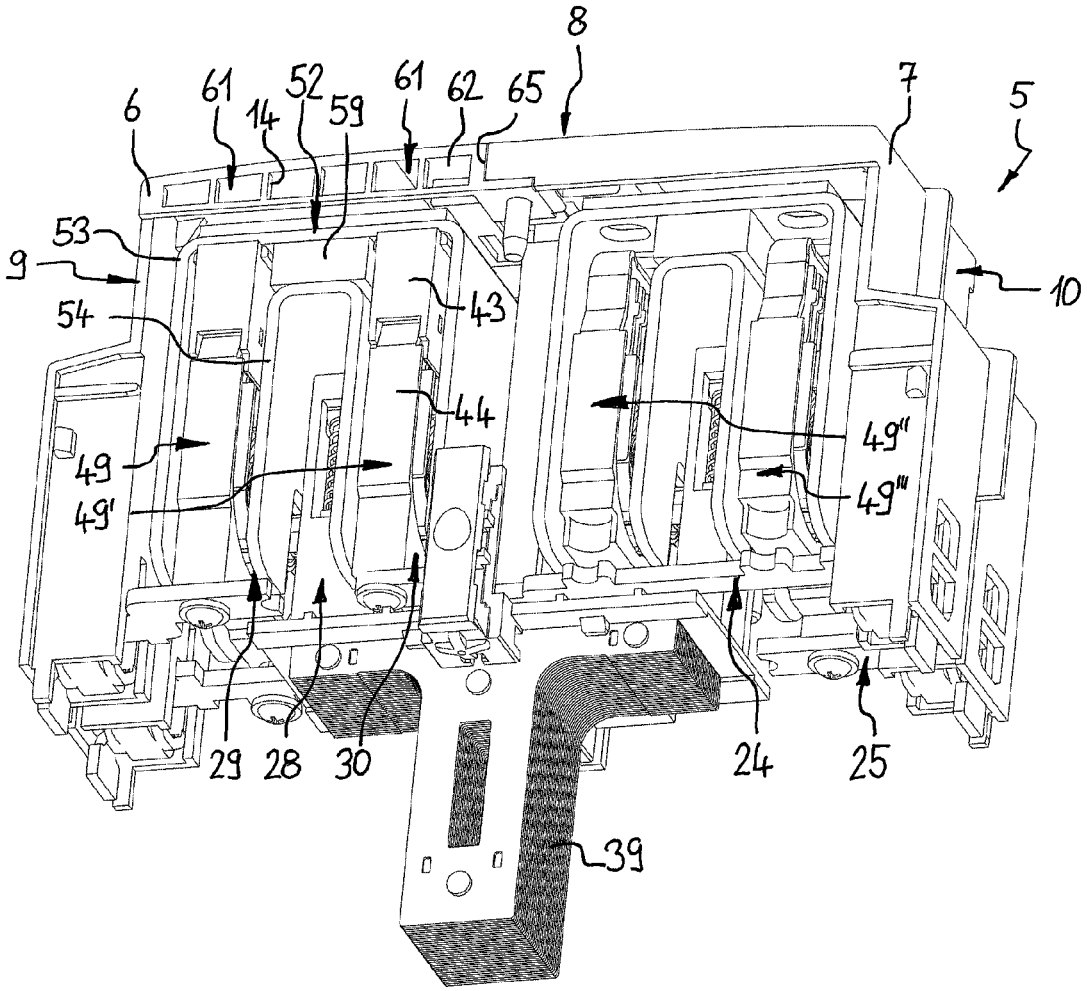
FIG. 7 a second version of the cover of a switching device in accordance with FIG. 1.

FIG. 7 shows an arrangement in accordance with FIG. 6, which shows that the outlet openings 14 are arranged in the first cover half 6 on the first longitudinal side 11. The outlet openings 15 of the second cover half 7 are arranged on the second longitudinal side 12 facing away from the first longitudinal side 11. Thus, the arc gases are blown to one side of the housing of a switch 28, which has two contact pairs 29, 30 and thus two switching chambers 49; and the arc gases from the other switch are blown out diagonally on the other side of the housing.

Figure 8:
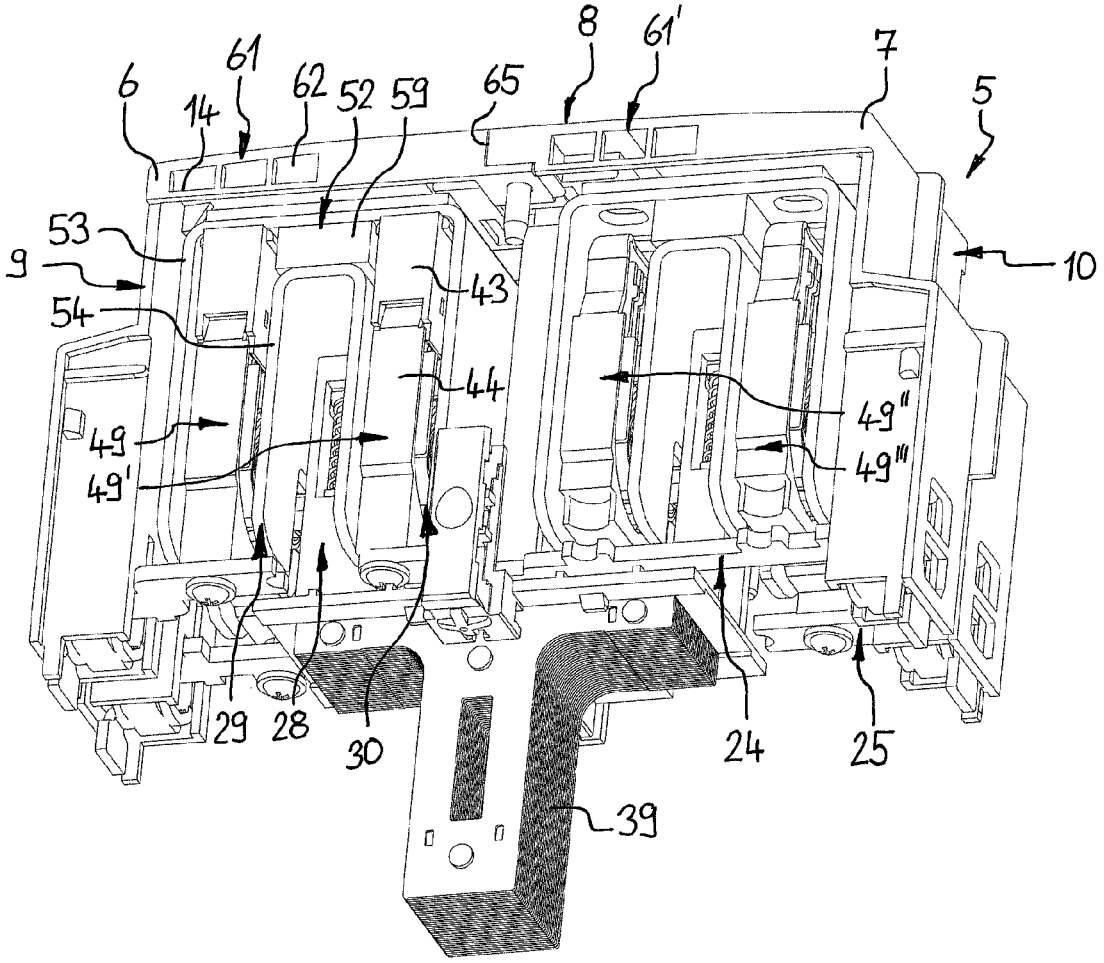
FIG. 8 a third version of a cover of a switching device in accordance with FIG. 1.

Alternatively, as shown in FIG. 8, the arc gases from both contact pairs 29, 30 of switch 28 can be blown out to different sides of the housing.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

LIST OF REFERENCE SYMBOLS

1 Contactor
2 Contactor
3 Housing
4 Lower case assembly
5 Upper case assembly
6 First cover half
7 Second cover half
8 Top side
9 First front side
10 Second front side
11 First longitudinal side
12 Second longitudinal side
13 Connection module
14 Exhaust opening
15 Exhaust opening
16 First connection contact
17 First connection contact
18 Contact opening
19 Contact opening
20 Screw opening
21 Screw opening
22 Mounting opening
23 Step
24 First current path
25 Second current path
26 Second connection contact

27 Second connection contact
28 Switch
29 First contact pair
30 Second contact pair
31 First contact
32 First contact
33 Fixed contact holder
34 Fixed contact holder
35 Bridge circuit piece
36 Second contact
37 Second contact
38 Guide rail ring
39 Switching bridge
40 Rail ring
41 First guide rail arrangement
42 Second guide rail arrangement
43 Arc extinguishing device
44 First guide rail
45 First guide rail
46 Second guide rail
47 Second guide rail
48 Connecting bracket
49 Switching chamber
50 Baffle
51 Outlet opening
52 Arc driver arrangement
53 Outer pole element
54 Inner pole element
55 Base bridge
56 Base bridge
57 Pole plate
58 Pole plate
59 Permanent magnet
60 Opening
61 Guide channel
62 Partial channel
63 Rib
64 Housing wall
65 Joint edge

The invention claimed is:

1. An electrical switching device, comprising:

a housing;

a first switching chamber within the housing that includes a first contact pair configured to interrupt a first current path;

a second switching chamber within the housing that includes a second contact pair configured to interrupt the first current path;

a third switching chamber within the housing that includes a third contact pair configured to interrupt a second current path;

a fourth switching chamber within the housing that includes a fourth contact pair configured to interrupt the second current path;

an arc extinguishing device for each switching chamber; and a respective guide channel within the housing for each switching chamber, the respective guide channel being configured to redirect the escaping arc gases from the respective switching chamber towards a respective exhaust opening for each switching chamber to allow the arc gases to exit from the housing, wherein the respective guide channels of the switching chambers are separated from each other, wherein the housing includes front sides including electrical connections configured for the first and second current paths, the front sides being connected at right angles to a longitudinal side wall, and wherein at least one of the respective exhaust openings is disposed in the longitudinal side wall.

2. The device of claim 1, wherein all the respective exhaust openings are disposed in the longitudinal side wall.

3. The device of claim 1, wherein the respective exhaust openings of the first and second switching chambers are disposed in the longitudinal side wall and the respective exhaust openings of the third and fourth switching chambers are disposed in an opposite longitudinal side wall of the housing.

4. The device of claim 1, wherein the respective exhaust openings of the first and third switching chambers are disposed in the longitudinal side wall and the respective exhaust openings of the second and fourth switching chambers are disposed in an opposite longitudinal side wall of the housing.

5. The device of claim 1, wherein the housing includes an upper side configured to attach one or more auxiliary switches.

6. The device of claim 1, wherein the respective guide channels are each divided into several partial channels.

7. The device of claim 1, wherein each respective guide channel causes a deviation of the arc gases by 90 degrees.

8. The device of claim 1, wherein the respective guide channels are integrated in the longitudinal side wall.

9. The device of claim 1, wherein the respective guide channels are each divided into several parallel partial channels.

* * * * *